US006261161B1

(12) United States Patent
Yan

(10) Patent No.: US 6,261,161 B1
(45) Date of Patent: Jul. 17, 2001

(54) SHARPENER ASSEMBLY FOR A FOOD SLICER AND RELATED METHOD

(75) Inventor: Gongpu Yan, Troy, OH (US)

(73) Assignee: Premark FEG L.L.C., Wilmington, DE (US)

( * ) Notice: Subject to any disclaimer, the term of this patent is extended or adjusted under 35 U.S.C. 154(b) by 0 days.

(21) Appl. No.: 09/225,934

(22) Filed: Jan. 6, 1999

(51) Int. Cl.[7] ..... B24B 49/00

(52) U.S. Cl. ..... 451/70; 451/192; 451/196; 451/198; 451/419; 451/268; 451/293; 83/174

(58) Field of Search ..... 451/45, 69, 190, 451/70, 192, 193, 194, 196, 198, 209, 210, 419, 420, 262, 268, 293; 83/174, 174.1

(56) References Cited

U.S. PATENT DOCUMENTS

| | | |
|---|---|---|
| 1,977,418 | 10/1934 | Winkler . |
| 2,026,096 | 12/1935 | Muhlbauer . |
| 2,052,365 | 8/1936 | Stukart . |
| 2,052,367 | 8/1936 | Folk . |
| 2,598,740 | 6/1952 | Zimmermann . |
| 2,665,531 | 1/1954 | Sivertsen . |
| 2,728,176 | 12/1955 | Ritzert . |
| 4,386,483 | 6/1983 | Schlaefli . |
| 4,732,056 | 3/1988 | Foster . |
| 4,811,521 | 3/1989 | Nakae et al. . |
| 5,101,704 | 4/1992 | Jones et al. . |
| 5,152,105 | 10/1992 | Belvederi . |
| 5,591,072 | 1/1997 | Tweed et al. . |

FOREIGN PATENT DOCUMENTS

| | | |
|---|---|---|
| 630702 | 11/1961 | (CA) . |
| 1187170 | 1/1959 | (DE) . |
| 4113854 | 4/1991 | (DE) . |
| 4244180 | 12/1992 | (DE) . |

OTHER PUBLICATIONS

PCT International Search Report; Application No. US 99/31303 filed Dec. 30, 1999.

*Primary Examiner*—Eileen P. Morgan
(74) *Attorney, Agent, or Firm*—Thompson Hine & Flory LLP

(57) ABSTRACT

A sharpener assembly for a food slicer includes a rotatable frame with a sharpening member and a truing member operatively connected for rotation with the frame. The frame is mounted on a food slicer to place the sharpening member and truing member on opposed sides of a slicer knife. The frame is rotated to rotate the sharpening member and the truing member into contact with respective sides of the slicer kife.

18 Claims, 7 Drawing Sheets

SHARPENER ASSEMBLY FOR A FOOD SLICER AND RELATED METHOD

TECHNICAL FIELD

The present invention relates to a sharpener assembly for a food slicer and, more particularly, to a sharpener assembly configured for enabling pivotal movement of a sharpening wheel and a truing wheel toward opposite sides of a knife of a food slicer.

BACKGROUND OF THE INVENTION

Typical food slicers have a base with a rotatable, circular or disc-like slicing knife mounter thereon, a gauge plate for determining the thickness of the slice and a carriage for supporting the food as it is moved past the cutting edge of the knife during slicing. The cutting edge of the knife tends to dull from use and therefore a sharpener is needed to sharpen the knife to maintain a good cutting edge for efficient slicing. Sharpening stones are typically brought against the knife's cutting edge as the knife rotates in order to provide such sharpening. A variety of sharpening devices have been used in the past to provide such sharpening.

Many existing sharpening devices suffer from using complex arrangements to convert a rotational movement into two translational movements. Other existing sharpening devices require two steps, a first in which a sharpening wheel or stone is brought into contact with one side of the knife to sharpen, and a second in which a truing wheel or stone is brought into contact with the opposite side of the knife to debur the knife edge.

U.S. Pat. No. 5,591,072 which is assigned to the assignee of the present application provides a sharpening device which overcame the problem of having to move the sharpening device between an inactive or stowed position and an active or sharpening position. However, the construction provided is relatively complex and includes a large number of parts adding to the expense of manufacture.

Canadian Patent No. 630,702 describes a slicer with a knife sharpener which includes sharpening wheels which can be positioned on opposite sides of a knife for sharpening, but as mentioned above, requires the sharpener to normally be stored in an inactive position when not in use and in such inactive position the sharpening wheels are not positioned on opposite sides of the knife. Further, the sharpener requires two handles to be operated in order to sharpen the slicer knife.

Another disadvantage of known knife sharpeners is that the sharpening stones or wheels typically need to be more abrasive than the truing stones or wheels used. This requirement adds to parts cost of sharpeners and requires a more exacting manufacturing process in order to assure that the wheels of appropriate abrasiveness are placed properly during manufacture.

Further, certain food slicers are adapted for use with more than one type of slicer knife, and different knives can have different attributes such as knife edge thickness. Many existing sharpener assemblies lack the ability to account for such differences between knife types.

Accordingly, it would be desirable and advantageous to provide a relatively simple sharpener assembly which is always positioned for sharpening when attached to a food slicer. It would likewise be desirable to provide a sharpener assembly operable to provide sharpening and truing simultaneously by a single rotational motion. Further, it would be desirable and advantageous to provide a sharpener assembly configured to permit the sharpening wheel and the truing wheel to have substantially the same abrasiveness while still providing effective sharpening. Still further, a sharpener assembly which enables adjustment of the amount of sharpening which is performed would also be advantageous.

SUMMARY OF THE INVENTION

In one aspect of the present invention a method of sharpening and truing a rotating slicer knife of a food slicer involves providing a rotatable sharpening wheel and a rotatable truing wheel on opposed sides of the slicer knife, the sharpening wheel and the truing wheel connected for pivotal movement toward the slicer knife upon rotation of a handle member. The handle member is rotated such that both the sharpening wheel and the truing wheel contact the slicer knife causing the sharpening wheel and the truing wheel to rotate. Relative rotation between the sharpening wheel and the slicer knife results in a sharpening grain acting inward along a cutting edge of the knife and relative rotation between the truing wheel and the slicer knife results in a truing grain acting outward along the cutting edge of the knife. The inward acting sharpening grain provides a more aggressive grinding action as desired for sharpening and the outward acting truing grain provides a less aggressive grinding action as desired for truing.

In another aspect of the present invention a sharpener assembly for a food slicer having a rotatable knife includes an assembly mount head having a recessed slot, the mount head including a through hole to the recessed. A frame having first and second spaced mount arms with a connecting member extending between the mount arms is provided, each mount arm including a through passage along its length. At least a portion of the connecting member is positioned within the mount head slot in alignment with the through hole. A first shaft extends through the through passage of the first mount arm and has a sharpening wheel connected to a first end thereof and a second shaft extends through the through passage of the second mount arm and has a truing wheel connected to a first end thereof. A handle is operatively connected to the frame connecting member through the through hole of the mount head for pivoting the frame. The subject assembly is preferably detachably connected to the base of the food slicer such that the sharpening wheel and truing wheel are normally positioned on opposite sides of the knife to facilitate sharpening as necessary by turning the handle to pivot the wheels into contact with the sides of the knife. Thus, a simple one-step rotation operation provides both sharpening and truing and there is no need for moving the assembly to an inactive position when it is not in use for sharpening and truing.

In yet another aspect of the invention a sharpener assembly for a food slicer having a rotatable knife includes a frame having first and second spaced mount arms with a connecting member extending between the mount arms. A first shaft extends from the first mount arm and has a first abrasive wheel connected to an end thereof and a second shaft extends from the second mount arm and has a second abrasive wheel connected to an end thereof. A first biasing member is positioned on the first shaft for biasing the first abrasive wheel away from the first mount arm and a second biasing member is positioned on the second shaft for biasing the second abrasive wheel toward the second mount arm. In the preferred embodiment one abrasive wheel is a sharpening wheel and the other abrasive wheel is a truing wheel and the force exerted by one of the biasing members on the sharpening wheel is greater than the force exerted by the other biasing member on the truing wheel. Such preferred construction facilitates using wheels having substantially the same abrasiveness for both the sharpening wheel and the truing wheel.

In a further aspect of the present invention a food slicer includes a base with a disc-like slicing knife mounted for rotation on the base and having a peripheral cutting edge. A knife guard extends about a portion of the peripheral cutting edge of the knife and includes first and second side portions extending along respective first and second sides of the knife. A sharpener assembly is detachably mounted to the base and includes a frame having first and second spaced mount arms with a connecting member extending between the mount arms, a first shaft extending from the first mount arm and having a first abrasive wheel connected to an end thereof, and a second shaft extending from the second mount arm and having a second abrasive wheel connected to an end thereof. The first abrasive wheel is positioned on the first side of the knife and the second abrasive wheel is positioned on the second side of the knife. The first side portion of the knife guard includes a first open region alignable with the first abrasive wheel and the second side portion of the knife guard includes a second open region alignable with the second abrasive wheel. This configuration provides a slicer with a sharpener assembly which is always in a ready position for sharpening.

The abrasive sharpening or truing wheels incorporated in to the sharpener assemblies may preferably be formed by a disc-shaped member having a knife engaging side which includes a recessed area surrounded by an annular abrasive surface, wherein the annular abrasive surface is frusto-conical in shape such that a central axis of the frusto-conical annular abrasive surface coincides with a central axis of the abrasive wheel.

DETAILED DESCRIPTION

Figure 1:
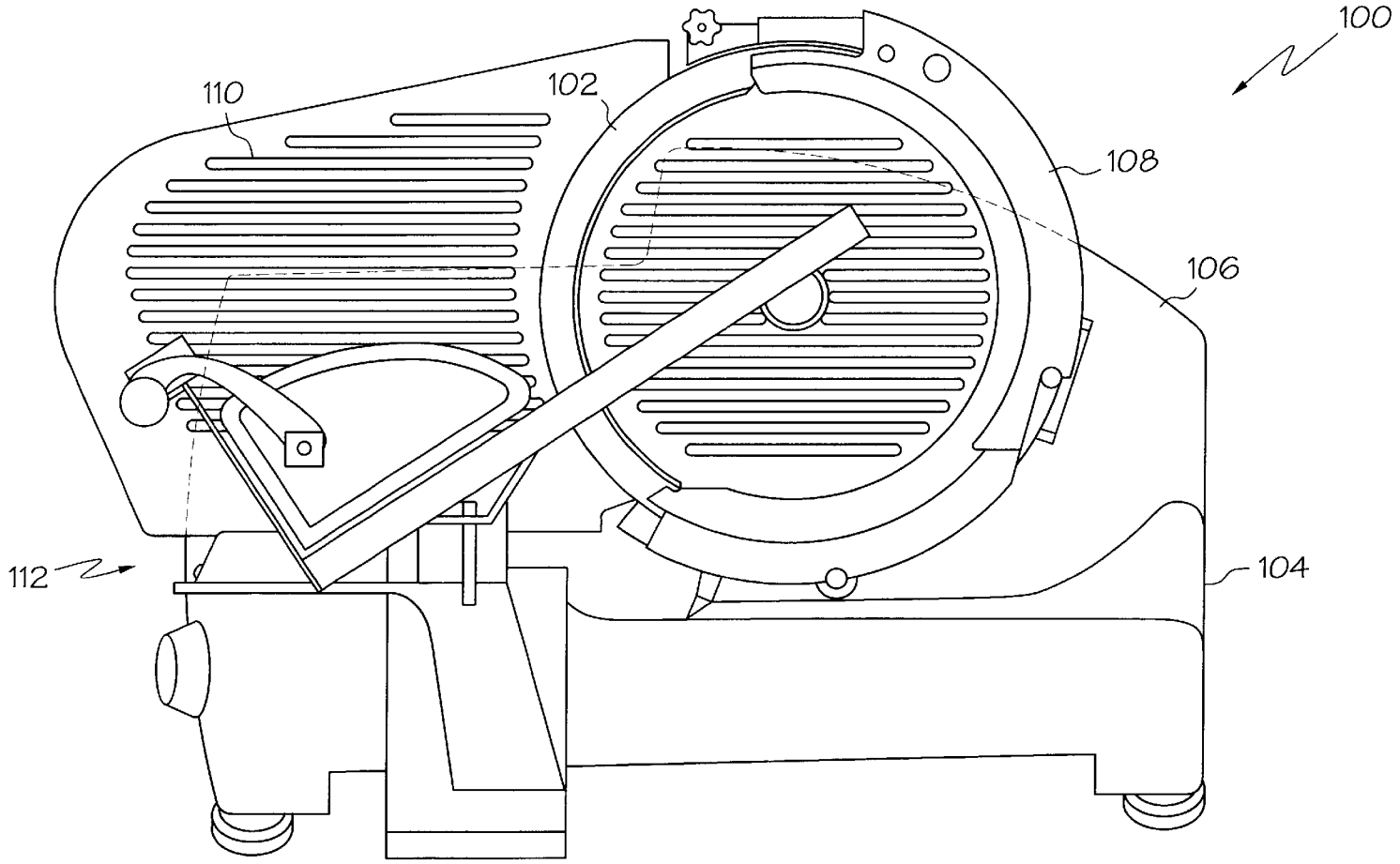
FIG. 1 PRIOR ART
FIG. 1 is a side view of a typical food slicer.

A typical food slicing machine 100 is shown in FIG. 1. It has a rotatable circular or disc-like slicing knife 102 mounted on a housing 104. The knife is mounted for rotation on a fixed axis shaft. The slicer 100 conventionally uses a ring guard (not shown) fastened thereto for the protection of the cutting edge of the slicing knife 102. The slicer 100 includes a cover plate 108 which is placed over the knife 102 and ring guard so that only a small portion of the knife blade is exposed. The slicer also includes a gauge plate 110 used to guide the food to be sliced and alter the thickness of the slices. The food is supported on carriage 112 which reciprocates in front of the blade.

In a typical embodiment of the present invention, a sharpener assembly which is mountable on a food slicer and a base assembly is provided. The sharpener preferably includes two abrasive stones which opposingly engage the front and rear sides or faces of the knife simultaneously to grind and hone a fine edge on the knife. The main abrasive stone is on the back side of the knife, i.e., the side opposite the food, and comprises a circular or disc-shaped abrasive stone mounted for rotation on a shaft. A similar abrasive stone carried on another shaft acts as a truing stone and comes into contact with the front side of the knife to debur the sharpened knife edge.

Figure 2:
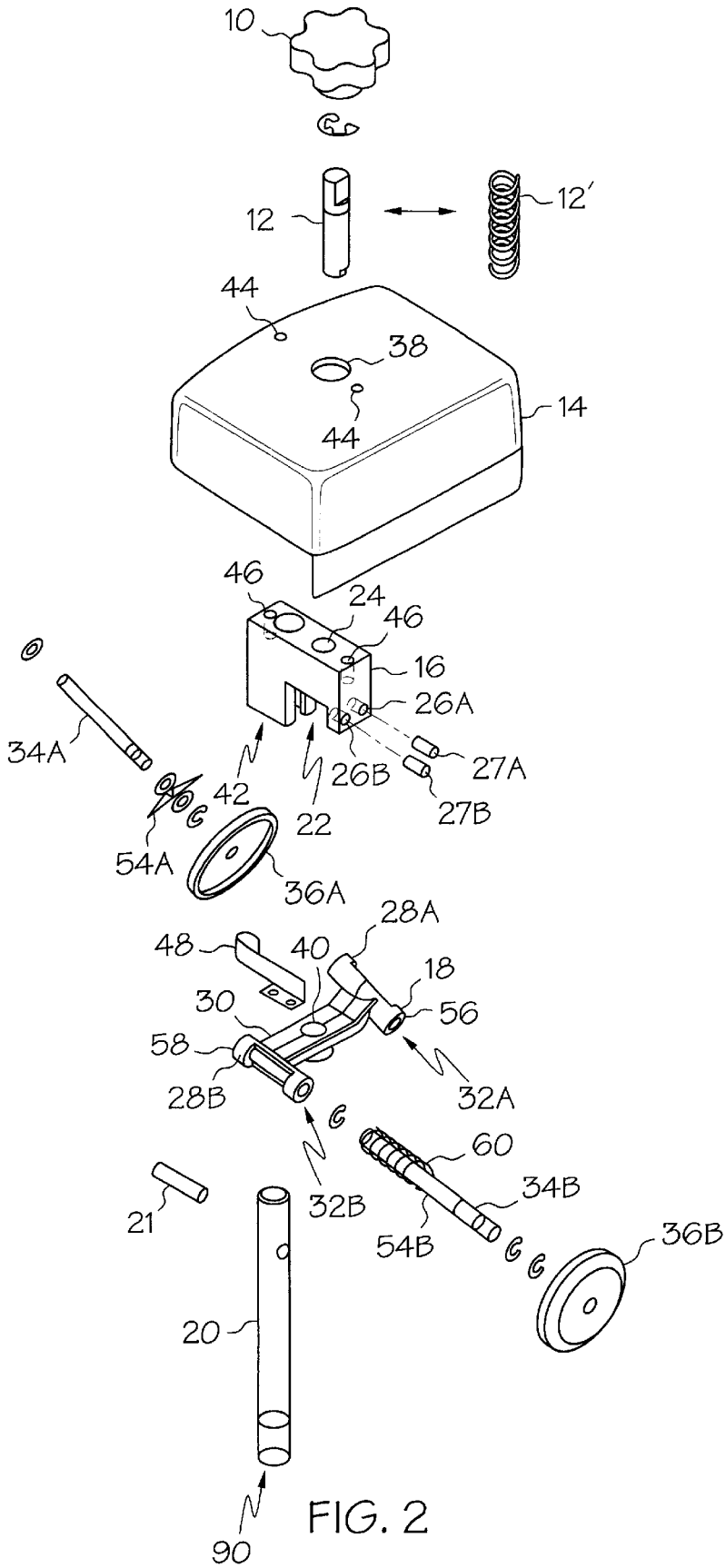
FIG. 2 is an exploded perspective view of one embodiment of a sharpener assembly.

An exploded perspective view of a sharpener assembly in accordance with one aspect of the present invention is shown in FIG. 2 and includes a handle 10, a handle shaft 12, a housing 14, a mount head 16, a frame 18, and a mount post or shaft 20. The mount head 16 includes a recessed slot 22, a through hole 24 which extends to the recessed slot 22, and threaded holes 26A, 26B which extend laterally into the recessed slot 22. The frame 18 includes spaced mount arms 28A, 28B with a connecting member 30 extending between the arms. Each mount arm includes a corresponding through passage 32A, 32B along its length. Each through passage receives a corresponding mount arm 34A, 34B to which the abrasive wheels 36A, 36B are rotatably attached. Housing 14 includes an opening 38 which aligns with mount head through hole 24 for permitting handle shaft 12 to extend to and connect to a handle receiving hole 40 in the connecting member 30 of frame 18. A bottom side of mount head 16 also includes an opening 42 which receives the assembly mount shaft 20, with the mount shaft being non-rotatably connected thereto. Holes 44 in housing 14 align with the corresponding holes 46 in mount head 16 to provide attachment of housing 14 to the mount head 16. A leaf spring type biasing member 48 is connectable to one side of the connecting member 30 of frame 18, such as by using aligned holes and screws. Although shown as separate attachable components, handle 10 and handle shaft 12 could be formed as an integral component with handle 10 being molded to handle shaft 12. It is also anticipated that handle shaft 12 could be replaced with a torsion spring 12', and use of such a torsion spring would act as a limit to the force applied by each abrasive wheel against the slicer knife 102 upon rotation of the handle 10 discussed below.

Figure 3:
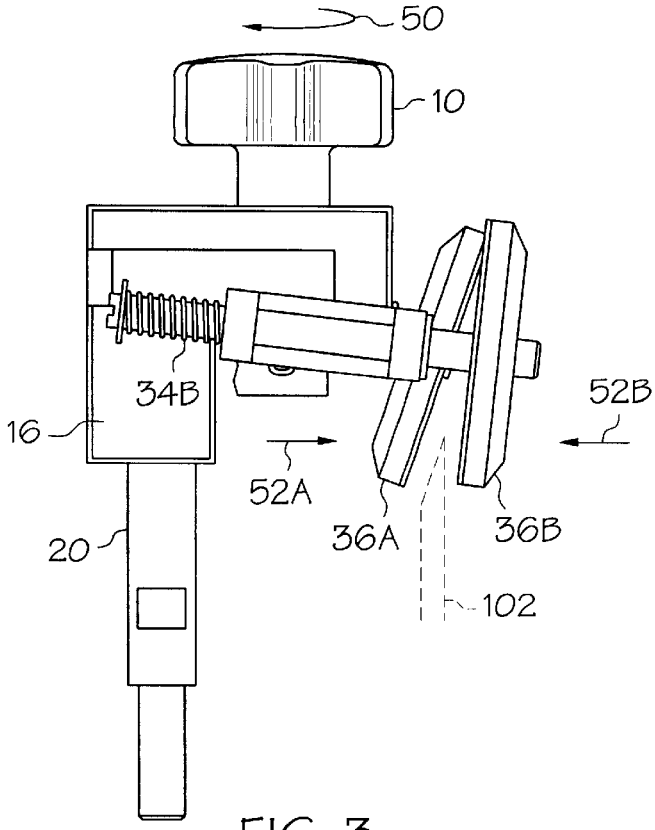
FIG. 3 is a side view of the assembled sharpener of FIG. 2 with the housing removed.

As best seen in the side elevation view of FIG. 3, when assembled, the abrasive wheels 36A, 36B are spaced from each other so as to be disposed on opposite sides of a slicer knife 102. The free end of assembly shaft 20 mounted in a non-rotatable manner with respect to a food slicer base, and with the opposite end of assembly shaft 20 mounted in a non-rotatable manner with respect to mount head 16, such as through use of a pin 21. Thus, when handle 10 is rotated in a clockwise manner as indicated by arrow 50, the frame 18 will likewise be rotated or pivoted within mount head slot 22 such that each abrasive wheel 36A, 36B moves toward the slicer knife 102 as indicated by arrows 52A, 52B until each abrasive stone contacts its corresponding side of the slicer knife 102 for sharpening and truing thereof. However, in the normal assembled position with handle 10 not rotated, biasing member 48, which may be a leaf spring type member, urges the respective abrasive wheels 36A, 36B into the non-contacting positions shown in FIGS. 2–3 via contact with the side of the mount head 16.

Advantageously, disposed on each shaft 34A, 34B is a biasing member 54A, 54B for urging the respective abrasive wheels 36A, 36B toward the slicer knife 102 as they engage the respective side of the knife 102. In particular, biasing member 54A (FIG. 2) may be a spring washer disposed about shaft 34A at a location between abrasive wheel 36A and an end 56 of mount arm 28A such that as abrasive wheel 36A contacts slicer knife 102 compression of biasing member 54A urges the abrasive wheel 36A into contact with the slicer knife 102 with a first predetermined force. Biasing member 54B may be a compression spring disposed about shaft 34B between an end 58 of mount arm 28B and an end 60 of shaft 34B. Thus, in the illustrated embodiment biasing member 54A biases abrasive wheel 36A away from mount arm 28A and biasing member 54B biases abrasive wheel 36B toward mount arm 28B. In order to facilitate use of similar abrasive wheels 36A, 36B having substantially the same abrasiveness, the force with which abrasive wheel 36A is urged away from mount arm 28A is preferably greater than the force with which abrasive wheel 36B is urged toward mount arm 28B, and abrasive wheel 36A acts as a sharpening wheel and abrasive wheel 36B acts as a truing wheel.

Figure 4:
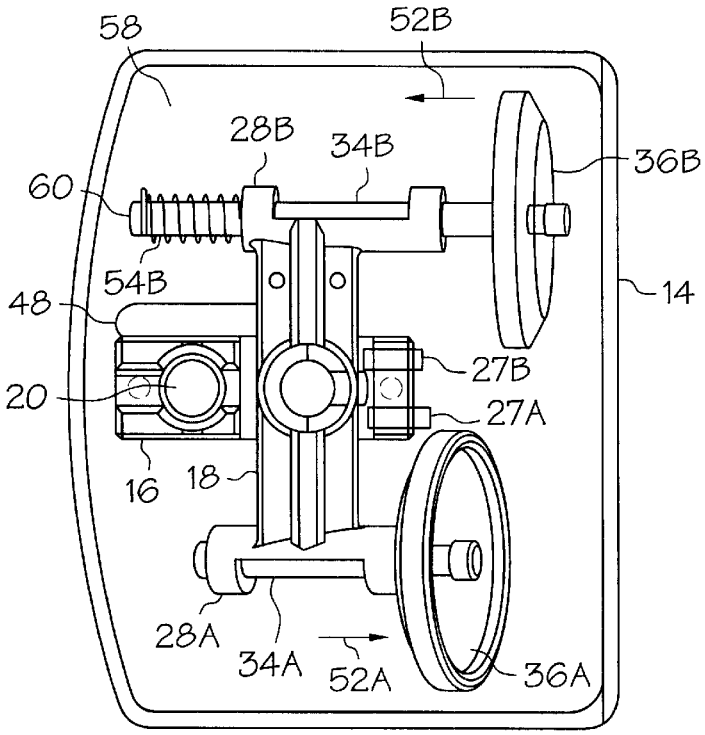
FIG. 4 is a bottom view of the sharpener of FIG. 3 with the housing included.

As best seen in the bottom view of FIG. 4, the pivot or rotation of frame 18 will be limited by the recessed slot 22 of mount head 16 because connecting member 30 of frame 18 will contact the sides of slot 22 after a predetermined amount of pivot or rotation. In order to provide adjustment of the amount of permitted rotation of frame 18 relative to mount head 16, one or more threaded passages 26A, 26B are provided into which threaded members such as set screws 27A, 27B may be positioned with interior ends of such set screws extending into slot 22. The set screws can be threaded further into slot 22 to reduce the permitted rotation of frame 18 or can be threaded further out of slot 22 to increase the permitted rotation of frame 18. This feature permits the sharpener assembly to be used in a larger variety of food slicers having knives of different types or dimensions.

Figure 5:
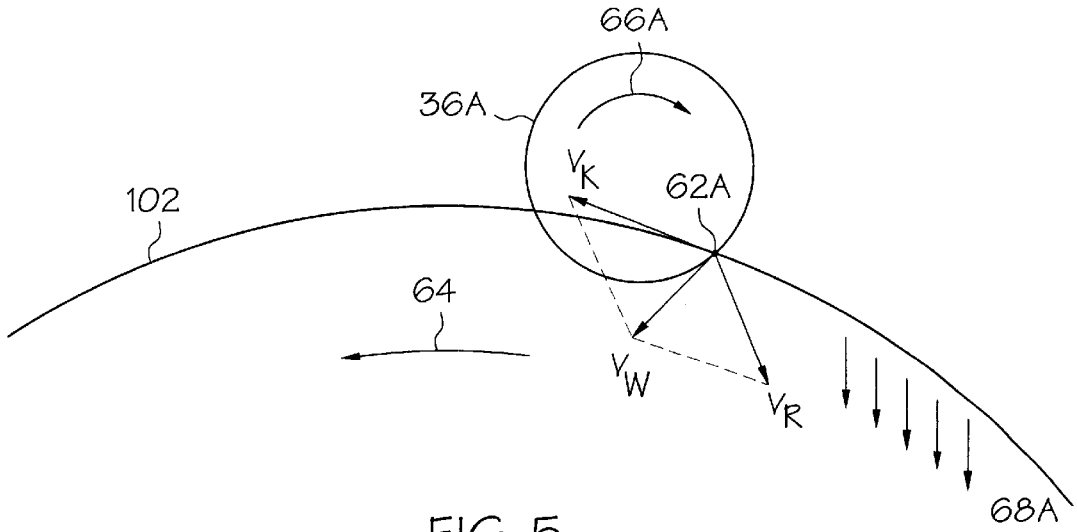
FIGS. 5 and 6 show sharpening and truing grains respectively.
Figure 6:
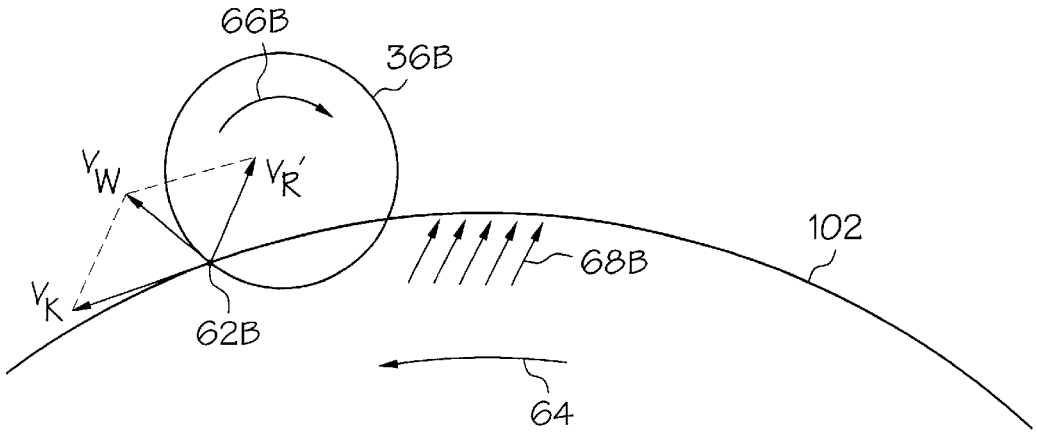

The abrasive wheels 36A, 36B each contact the slicer knife 102 so as to result in a preferred sharpening or truing grain as the case may be. Referring to FIGS. 5 and 6, with abrasive wheel 36A acting as the sharpening wheel, contact between the wheel and the slicer knife 102 is shown at 62A. Arrow 64 indicates the direction of rotation of slicer knife 102 and arrow 66A indicates the direction of rotation of wheel 36A upon contact with the slicer knife 102. The velocity vector $V_K$ of the knife and the velocity vector $V_W$ of the wheel combine to provide a relative velocity vector $V_R$ (of the wheel relative to the knife) which provides a sharpening grain in the direction indicated by arrow 68A, inward along the knife edge which make grinding more aggressive as desired for sharpening. In FIG. 6, contact between wheel 36B and slicer knife 102 is indicated at 62B. The direction of rotation of slicer knife 102 is again indicated by arrow 64 and the direction of rotation of wheel 36B is indicated by arrow 66B. The velocity vector $V_K$ of the knife and the velocity vector $V_W$ of the wheel combine to provide a relative velocity vector $V_{R'}$ (of the wheel relative to the knife) which provides a truing grain in the direction indicated by arrow 68B, outward along the knife edge which makes grinding less aggressive as desired for truing. Accordingly, this feature also facilitates use of wheels 36A, 36B having similar abrasive properties. It is recognized that the direction of the sharpening grain and the truing grain may vary depending upon the exact configuration of the knife as well as other factors.

Figure 7:
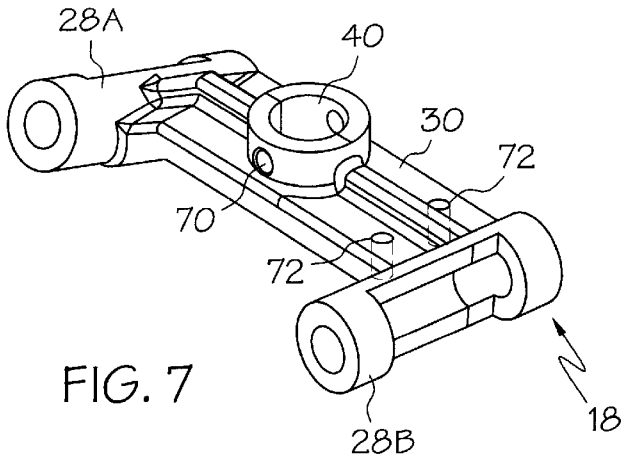
FIGS. 7–10 show the frame member of the sharpener of FIG. 2.

An enlarged view of the frame 18 is depicted in FIGS. 7–10. Referring to FIG. 7, a perspective view of frame 18 is shown in which the frame is upside down relative to its position shown in FIG. 2. In this enlarged view it is apparent that the mount arms 28A, 28B are angled in relation to each other in order to facilitate proper contact of the respective abrasive wheel with the sides of the slicer knife 102. A lateral opening 70 is shown for receiving a pin or set screw to connect the handle shaft 12 to the frame 18. Also shown are threaded holes 72 for securing the leaf spring type biasing member 48 thereto.

Figure 8:
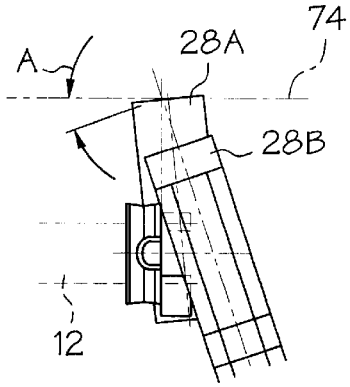
Figure 9:
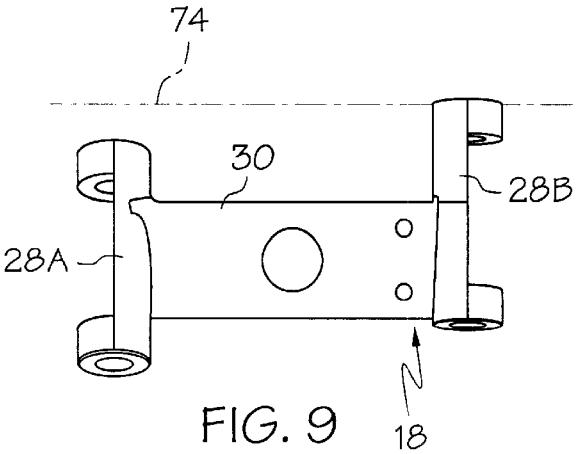
Figure 10:
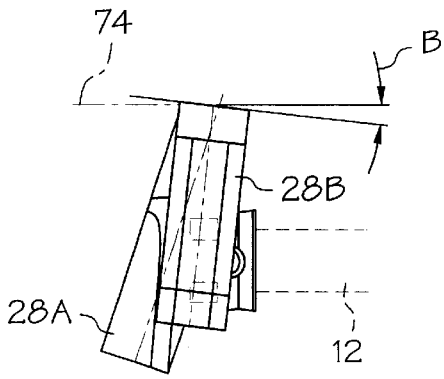

In FIGS. 8–10 line 74 represents a plane which runs parallel to the axis of the handle shaft 12 and is used to define the angular relationship between mount arms 28A and 28B. As shown in FIG. 8 mount arm 28A intersects plane 74 at an angle A and as shown in FIG. 10 mount arm 28B intersects plane 74 at an angle B. In one embodiment of the invention angle A might be on the order of about 19 degrees and angle B might be on the order of about 6 degrees. However, it is recognized that such angles could vary depending upon the exact configuration of the slicer knife 102 as well as other factors including the exact configuration of the abrasive wheels 36A, 36B.

Figure 11:
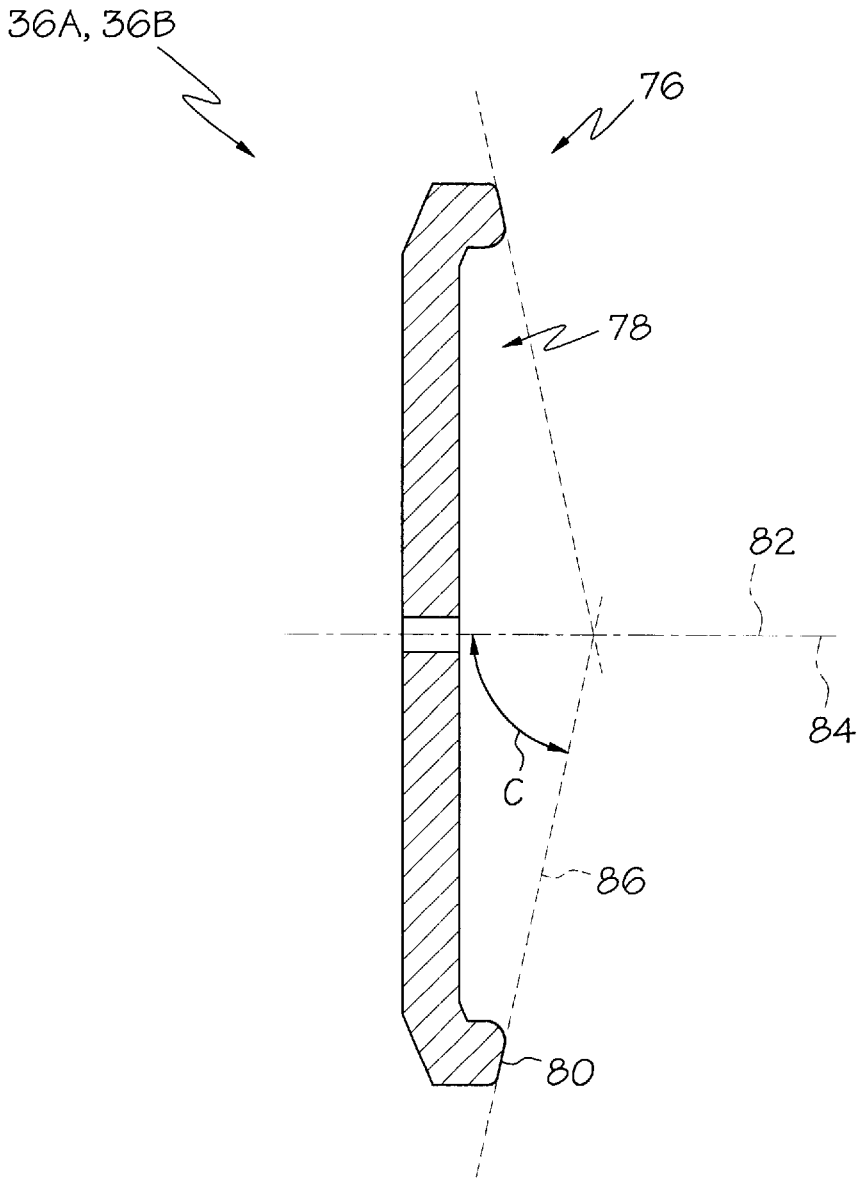
FIG. 11 shows an enlarged cross-sectional view of one embodiment of an abrasive wheel of the present invention.

With respect to the configuration of abrasive wheels 36A, 36B, reference is made to FIG. 11 showing an enlarged cross-sectional side view of a representative abrasive wheel. As shown, in a preferred embodiment the abrasive wheel is a generally disc shaped member having a knife engaging side 76 which includes a recessed area 78 which is surrounded by an annular abrasive surface 80. Surface 80 may, for example, include an abrasive coating of cubic boron nitride. Abrasive surface 80 is preferably frusto-conical in shape as shown, with a central axis of 82 of the frusto-conical abrasive surface coinciding with an axis 84 of rotation of the wheel. Further, a line 86 extending from and parallel to the annular surface 80 at a point thereabout and to the axis of rotation 84 intersects the axis of rotation 84 at a non perpendicular angle. In particular, angle C of such intersection is preferably in the range of about 80 to 84 degrees. However, it is recognized that such angle could vary depending up the exact configuration of the slicer knife 102 as well as other factors including the angular relationship between mount arms 28A and 28B.

With respect to attachment of the sharpener assembly to the food slicer, mount shaft 20 is used as previously mentioned. The mount shaft 20 includes an opening 90 at the bottom thereof for positioning on a mount boss (not shown) of a food slicer base. The opening 90 (FIGS. 2 and 3) and the mount boss may be appropriately configured to prevent rotational movement of the mount shaft 20 relative to the mount boss. It is recognized that other manners of connecting the sharpener assembly to the slicer are possible.

Figure 12:
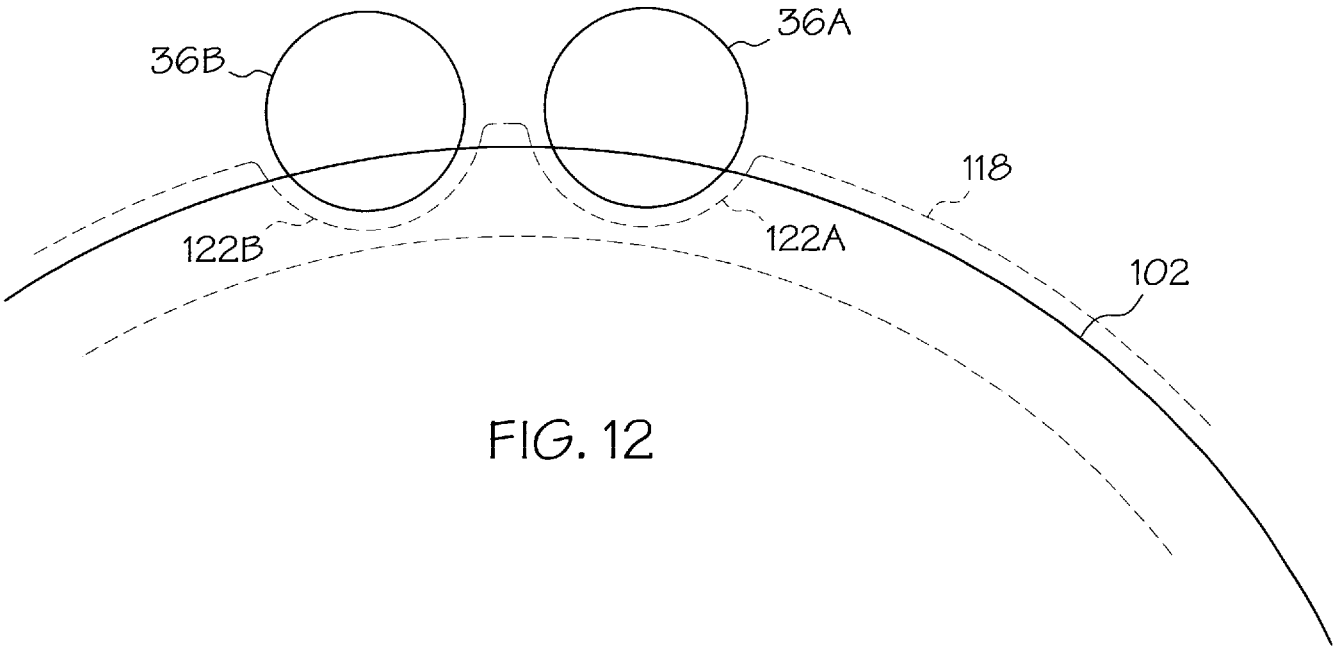
FIGS. 12 and 13 show alternative configurations of a blade guard adopted for use with the present invention.
Figure 13:
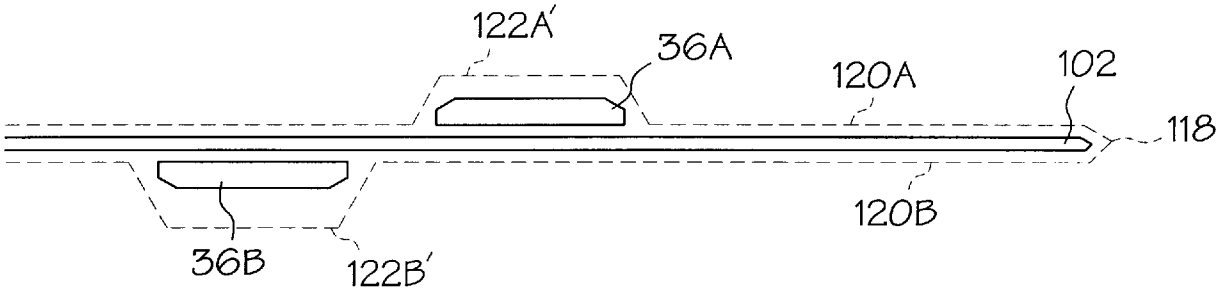

Referring to FIGS. 12–13, a knife guard 118 is preferably configured for facilitating the positioning of the abrasive wheels 36A, 36B on opposed sides of the slicer knife 102. In this regard, the knife guard 118 typically includes side portions 120A, 120B which extend along opposed sides of the slicer knife 102. In order to provide access to the sides of the slicer knife 102, each side portion of the knife guard 118 preferably includes a respective open region aligned with the abrasive wheel adjacent thereto. As shown in the side view of FIG. 12, such open regions may take the form of radially recessed regions 122A and 122B. In another embodiment shown in the top view of FIG. 13, the open regions may take the form of laterally spaced regions 122A' and 122B' of side portions 120A and 120B respectively. Such configurations allow the sharpener assembly to be located in a sharpening position at all times while permitting the sharpener assembly to be easily removable from the food slicer.

Although the invention has been described and illustrated in detail it is to be clearly understood that the same is intended by way of illustration and example only and is not intended to be taken by way of limitation. For example, the respective functions (sharpening or truing) of the abrasive wheels could be reversed as needed depending upon the knife configuration and the mounting location of the assembly. Further, a sharpener assembly could utilize a sharpening wheel of different abrasiveness than the truing wheel without departing from the broader aspects of the present invention. Accordingly, the spirit and scope of the invention are to be limited only by the terms of the appended claims.

What is claimed is:

1. A sharpener assembly for a food slicer having a rotatable knife, comprising:

an assembly mount head having a recessed slot, said mount head including a through hole to said recessed slot;

a frame having first and second spaced mount arms with a connecting member extending between said mount arms, each mount arm including a through passage along its length, at least a portion of said connecting member positioned within said mount head slot in alignment with said through hole;

a first shaft extending through said through passage of said first mount arm and having a sharpening wheel connected to a first end thereof;

a second shaft extending through said through passage of said second mount arm and having a truing wheel connected to a first end thereof; and a handle operatively connected to said frame connecting member through said through hole of said mount head for pivoting said frame relative to said mount head to rotate said sharpening wheel and said truing wheel into contact with a knife during a sharpening operation.

2. The sharpener assembly of claim 1 further comprising a mount post extending from said mount head for mounting said assembly to a slicer to prevent pivot of said mount head when said handle is turned.

3. The sharpener assembly of claim 2 further comprising a first biasing member and a second biasing member, said first biasing member positioned on said first shaft between said sharpening wheel and said first mount arm for biasing said sharpening wheel away from said first mount arm, and said second biasing member positioned on said second shaft between said second mount arm and a second end of said second shaft for biasing said truing wheel toward said second mount arm.

4. The sharpener assembly of claim 3 wherein said first biasing member urges said sharpening wheel away from said first mount arm with a first force and said second biasing member urges said truing wheel toward said second mount arm with a second force, said first force being greater than said second force, and said sharpening wheel and said truing wheel having substantially the same abrasiveness.

5. The sharpener assembly of claim 1 wherein said mount head slot limits pivotal movement of said frame.

6. The sharpener assembly of claim 5 wherein said mount head includes at least one threaded hole extending to said slot and having a threaded member positioned therein for extending into said slot and contacting said frame connecting member upon pivot of said frame rotational adjustment of said threaded member effecting adjustment of permitted pivotal movement of said frame relative to said mount head.

7. The sharpener assembly of claim 1 wherein said handle is connected to said frame connecting member by a shaft which rotates with said handle and said frame.

8. The sharpener assembly of claim 1 wherein said handle is connected to said frame connecting member by a torsion spring which moves relative to said mount head and includes a portion fixed to said handle and a portion fixed to said frame.

9. The sharpener assembly of claim 1 wherein said first mount arm is angled relative to said second mount arm.

10. The sharpener assembly of claim 1 further comprising a housing disposed between said handle and said mount head and said frame, said housing extending over said sharpening wheel and said truing wheel.

11. A food slicer comprising:

a base;

a disc-like slicing knife mounted for rotation on said base and having a peripheral cutting edge;

a knife guard extending about a portion of said peripheral cutting edge of said knife and including first and second side portions extending along respective first and second sides of said knife;

a sharpener assembly according to claim 1; and wherein said first side portion of said knife guard includes a first open region alignable with one of said sharpening wheel and said truing wheel and said second side portion of said knife guard includes a second open region alignable with the other of said sharpening wheel and said truing wheel.

12. A sharpener assembly for a food slicer having a rotatable knife, comprising:

a frame having first and second spaced mount arms with a connecting member extending between said mount arms;

a first shaft extending from said first mount arm and having a first abrasive wheel connected to an end thereof;

a second shaft extending from said second mount arm and having a second abrasive wheel connected to an end thereof;

a first biasing member positioned on said first shaft for biasing said first abrasive wheel away from said first mount arm;

a second biasing member positioned on said second shaft for biasing said second abrasive wheel toward said second mount arm: and an assembly mount head positioned adjacent said frame;

a handle operatively connected to said frame for pivoting said frame relative to said mount head; and adjustable means for limiting pivot of said frame relative to said mount head.

13. The sharpener assembly of claim 12 wherein said first mount arm is angled relative to said second mount arm.

14. The sharpener assembly of claim 13 wherein said first abrasive wheel and said second abrasive wheel are spaced from each other to define a knife receiving area.

15. The sharpener assembly of claim 12 wherein said handle is connected to said frame by a torsion spring.

16. The sharpener assembly of claim 12 wherein said first abrasive wheel comprises a sharpening wheel and said second abrasive wheel comprises a truing wheel.

17. The sharpener assembly of claim 12 wherein said first abrasive wheel comprises a disc-shaped member having a knife engaging side which includes a recessed area surrounded by an annular abrasive surface, wherein said annular abrasive surface is frusto-conical in shape, a central axis of said frusto-conical annular abrasive surface coinciding with an axis of rotation of said first abrasive wheel.

18. A food slicer comprising:

a base;

a disc-like slicing knife mounted for rotation on said base and having a peripheral cutting edge;

a knife guard extending about a portion of said peripheral cutting edge of said knife and including first and second side portions extending along respective first and second sides of said knife;

a sharpener assembly according to claim 12; and wherein said first side portion of said knife guard includes a first open region alignable with said first abrasive wheel and said second side portion of said knife guard includes a second open region alignable with said second abrasive wheel.

* * * * *